US006958573B1

(12) United States Patent
Azzi et al.

(10) Patent No.: US 6,958,573 B1
(45) Date of Patent: Oct. 25, 2005

(54) ASYMMETRIC SHUNT FOR DEFLECTION YOKE FOR REDUCING DIAGONAL SYMMETRIC DEFECTS

(75) Inventors: Nacerdine Azzi, Fontaine les Dijon (FR); Sebastien Volatier, Genlis (FR); Olivier Masson, Dijon (FR)

(73) Assignee: Thomson Licensing S.A., Boulogne-Billancourt (FR)

( * ) Notice: Subject to any disclaimer, the term of this patent is extended or adjusted under 35 U.S.C. 154(b) by 0 days.

(21) Appl. No.: 09/454,875

(22) Filed: Dec. 3, 1999

(51) Int. Cl.[7] ..... H01J 29/70
(52) U.S. Cl. ..... 313/440; 335/213
(58) Field of Search ..... 335/213, 210; 313/440, 412, 431, 421, 413

(56) References Cited

U.S. PATENT DOCUMENTS

| | | | | | |
|---|---|---|---|---|---|
| 3,356,879 | A | * | 12/1967 | Rennick | 335/212 |
| 3,721,930 | A | * | 3/1973 | Barkow et al. | 335/213 |
| 4,117,516 | A | * | 9/1978 | Yasuhara | 335/210 |
| 4,143,345 | A | * | 3/1979 | Barkow | 335/210 |
| 4,233,582 | A | * | 11/1980 | Abe et al. | 335/213 |
| 4,618,843 | A | * | 10/1986 | Nakamura | 335/210 |
| 4,939,415 | A | * | 7/1990 | Iwasaki et al. | 313/440 |
| 4,972,519 | A | * | 11/1990 | Grote | 313/440 |
| 4,975,618 | A | * | 12/1990 | Koba et al. | 313/440 |
| 5,378,961 | A | * | 1/1995 | Shiro et al. | 313/430 |
| 5,523,658 | A | * | 6/1996 | Fukuma et al. | 315/368.19 |
| 5,550,522 | A | * | 8/1996 | Dekkers et al. | 335/213 |
| 6,107,904 | A | * | 8/2000 | Azzi et al. | 335/210 |

FOREIGN PATENT DOCUMENTS

| | | | | |
|---|---|---|---|---|
| EP | 0470315 | | 2/1992 | |
| EP | 0952604 | | 10/1999 | |
| FR | 2034201 | | 12/1970 | |
| GB | 709382 | | 5/1954 | |
| JP | 02-216738 | * | 9/1990 | H01J 29/73 |

OTHER PUBLICATIONS

Copy of Search Report.

* cited by examiner

*Primary Examiner*—Vip Patel
*Assistant Examiner*—Glenn Zimmerman
(74) *Attorney, Agent, or Firm*—Joseph S. Tripoli; Harvey D. Fried; Christine Johnson

(57) ABSTRACT

Deflection yoke for a cathode-ray tube has at least one pair of saddle-shaped coils. The saddle-shaped coils form an asymmetric field in the vicinity of a front conductor assembly. The field asymmetry is produced by an inclusion near the front conductor assembly of at least a metal piece. The purpose of this asymmetry is to minimize the effects of an orthogonality defect between the deflection fields created by the horizontal and vertical deflection coils on the geometry of the image.

3 Claims, 6 Drawing Sheets

ASYMMETRIC SHUNT FOR DEFLECTION YOKE FOR REDUCING DIAGONAL SYMMETRIC DEFECTS

BACKGROUND OF THE INVENTION

The invention relates to a deflection unit for a colour cathode-ray tube, which unit is also called a deflection yoke, which includes a pair of horizontal deflection coils and a pair of vertical deflection coils in the form of a saddle, the particular shape of which makes it possible to minimize the coma, geometry and convergence errors of the beams simultaneously.

A cathode-ray tube intended to generate colour images generally comprises an electron gun which emits three coplanar electron beams, each beam being intended to excite a phosphor for a specific primary colour (red, green or blue) on the screen of the tube.

The electron beams scan the screen of the tube due to the effect of the deflection fields created by the horizontal and vertical deflection coils of the deflection yoke fixed to the neck of the tube. A separator made of plastic serves to isolate the two pairs of coils and to ensure that the deflection yoke is mechanically rigid. A ring of ferromagnetic material conventionally surrounds the deflection coils so as to concentrate the deflection fields in the appropriate region.

The three beams generated by the electron gun must always converge on the screen of the tube on pain of introducing a so-called convergence error which falsifies, in particular, the rendition of the colours. In order to make the three coplanar beams converge, it is known to use so-called self-converging astigmatic deflection fields; in a self-converging deflection coil, the intensity of the field or the lines of flux which are caused by the horizontal deflection winding are generally in the form of a pin-cushion in a portion of the coil which lies more to the front of the latter on the side of the tube which faces the screen. This amounts to introducing, into the distribution of the turns making up the line coil, a highly positive 3rd harmonic of the ampere-turns density at the front of the coil.

Moreover, due to the action of uniform horizontal and vertical deflection magnetic fields, the volume scanned by the electron beams is a pyramid, the apex of which is coincident with the centre of deflection of the deflection yoke and the intersection of which with a non-spherical screen surface exhibits a geometrical defect called pin-cushion distortion. This geometrical distortion of the image is all the greater the larger the radius of curvature of the screen of the tube. Self-converging deflection yokes generate astigmatic deflection fields making it possible to modify the North/South and East/West geometry of the image and, in particular, partially compensate for the North/South pin-cushion distortion.

The design of the deflection yoke must also take into account the coma, which is an aberration affecting the lateral beams emanating from an electron gun emitting three beams in line, independently of the astigmatism of the deflection fields and of the curvature of the screen surface of the tube; these lateral beams enter the deflection zone at a low angle with respect to the axis of the tube and undergo a deflection in addition to that of the axial beam. The coma is generally corrected by modifying the distribution of the deflection fields at the point where the beams enter the deflection yoke so that the coma generated compensates for that produced by the distribution of the field which is necessary in order to obtain the desired astigmatism for achieving self-convergence. Thus, with regard to the horizontal deflection field, the field at the rear of the deflection yoke is in the form of a barrel and in the front part in the form of a pin-cushion.

In addition, the two, horizontal and vertical, pairs of deflection coils must generate deflection fields which are strictly perpendicular to each other. If the two fields are not perpendicular, a phenomenon occurs in which one field is modulated with respect to the other. Since the amplitude of the horizontal deflection coil control signals is about 900 volts whereas the vertical deflection coils are supplied with approximately 50 volts, the vertical deflection coils act as the secondary of a transformer, the primary of which would be the horizontal deflection coils. This modulation effect, also called cross-modulation, is more commonly defined by the expression $X\ Mod=100\times Vv/Vh$, where Vv is the voltage measured at the vertical deflection coils when the horizontal deflection coils are supplied with Vh. The cross-modulation generates geometrical problems in the image created on the screen of the tube by the scanning of the electron beams.

These problems are, for example, orthogonality and parallelogram faults. The correction of these faults requires them to be taken into account when designing the deflection yoke, but this process of taking them into account is difficult, or even impossible, since the defects result from manufacturing problems which arise in the first phases of manufacturing the deflection yoke, when the design stage has been completed; hitherto, it was therefore necessary to remedy these problems either by introducing a new step in the design of the deflection coils or by using electronic control circuits capable of being responsible for the geometrical corrections of the image. The invention provides a simple solution to these problems, by modifying the front conductor assembly of a pair of saddle shaped coils and by introducing a shape asymmetry into said conductor assembly. This modification is introduced into the manufacture by modifying the shape of the coil shaper placed in front of the mould in which the winding takes place, which modification has no effect on the other parameters defined in the design of the coil, such as the convergence of the three electron beams or the coma.

SUMMARY OF THE INVENTION

To do this, the deflection yoke for a colour cathode-ray tube according to the invention comprises a pair of horizontal deflection coils, a pair of vertical deflection coils, these coils being intended to generate magnetic deflection fields perpendicular to a main axis Z, at least one of these two pairs consisting of saddle-shaped coils, the conducting wires of each of the said coils being arranged so as to form a front conductor assembly and a rear conductor assembly, the two conductor assemblies being connected to each other by two lateral conductor bundles, those parts of each of said coils which form the rear conductor assembly and the lateral bundles being arranged approximately symmetrically with respect to a plane P, said deflection yoke being characterized in that it has means for locally modifying the direction or the amplitude of the magnetic field created by the current flow in said conductor assembly so that, considering a first zone of the front conductor assembly and a second zone symmetrical with the first zone with respect to P, the fields H, H' created in the first and second zones are not symmetrical with respect to P.

BRIEF DESCRIPTION OF THE DRAWING

The invention will be more clearly understood with the aid of the description below and of the drawings among which.

DESCRIPTION OF THE PREFERRED EMBODIMENTS

Figure 1:
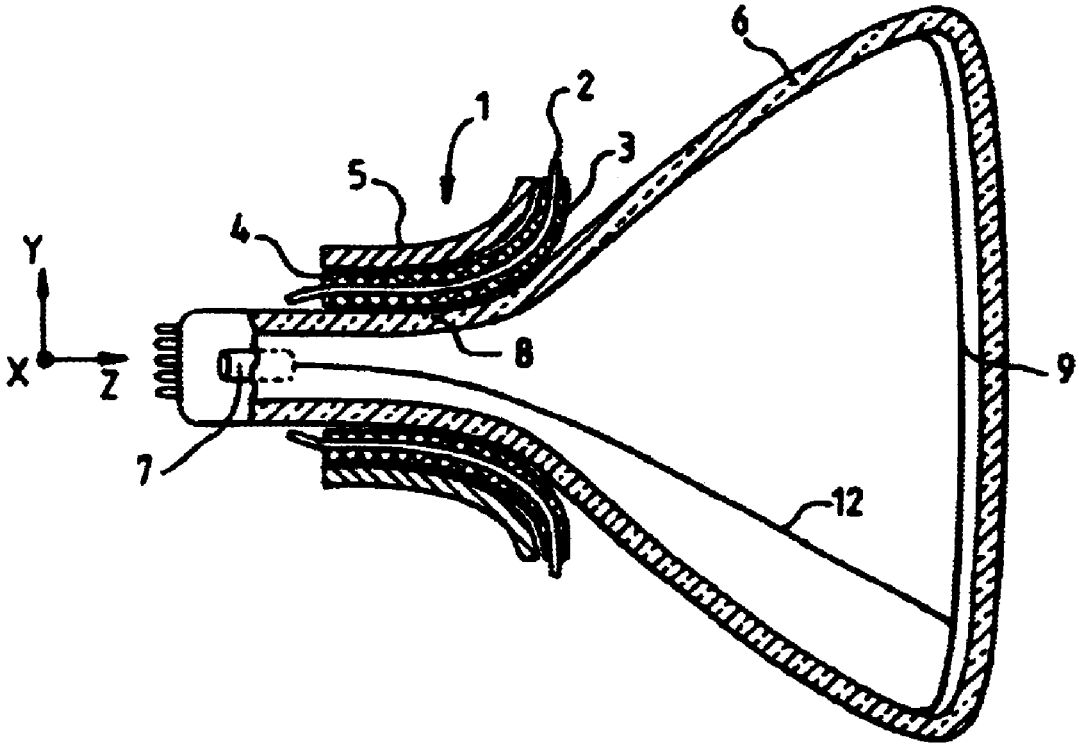
FIG. 1 shows, in a cross-section, deflection yoke according to the invention fitted onto the neck of a cathode-ray tube.

FIG. 1 shows, in cross-section, a deflection yoke 1 according to the invention, placed on the neck 8 of a cathode-ray tube 6. The deflection yoke comprises a pair of vertical deflection coils 4, a horizontal pair of deflection coils 3, the two pairs being insulated from each other by a separator 2 generally made of plastic, and a ring 5 of ferromagnetic material intended to concentrate the magnetic fields created by the coils 3 and 4. These fields deflect the electron beams 12 created by the electron gun 7 so that said beams scan the screen 9 of the tube 6.

Figure 2A:
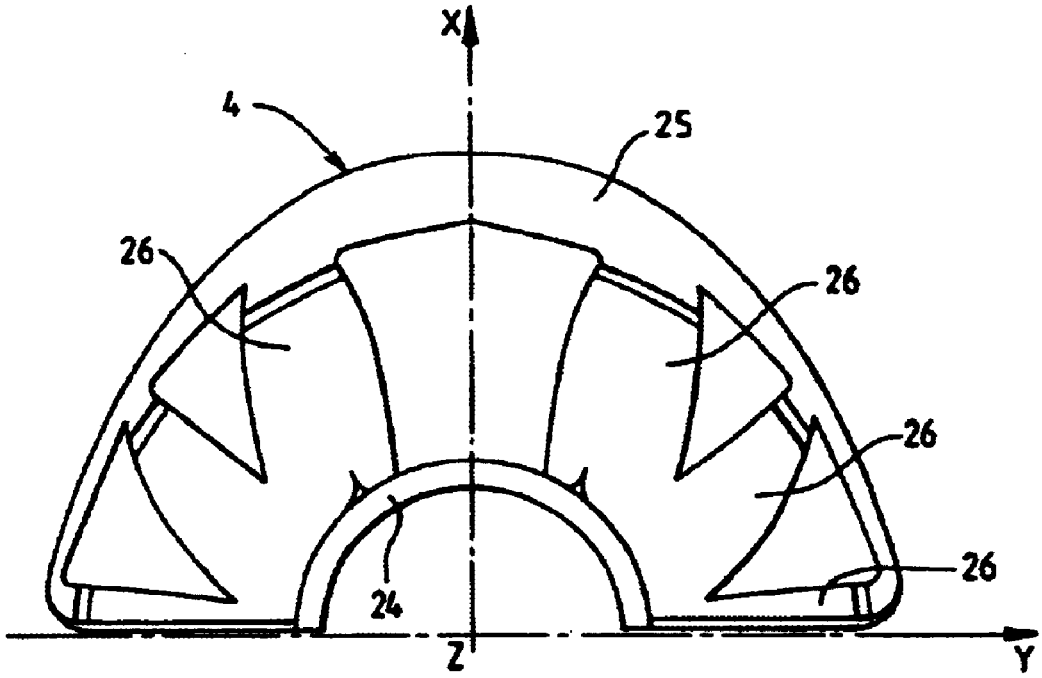
FIGS. 2A and 2B show, seen from the front and from above, a saddle-shaped coil according to the state of the art.
Figure 2B:
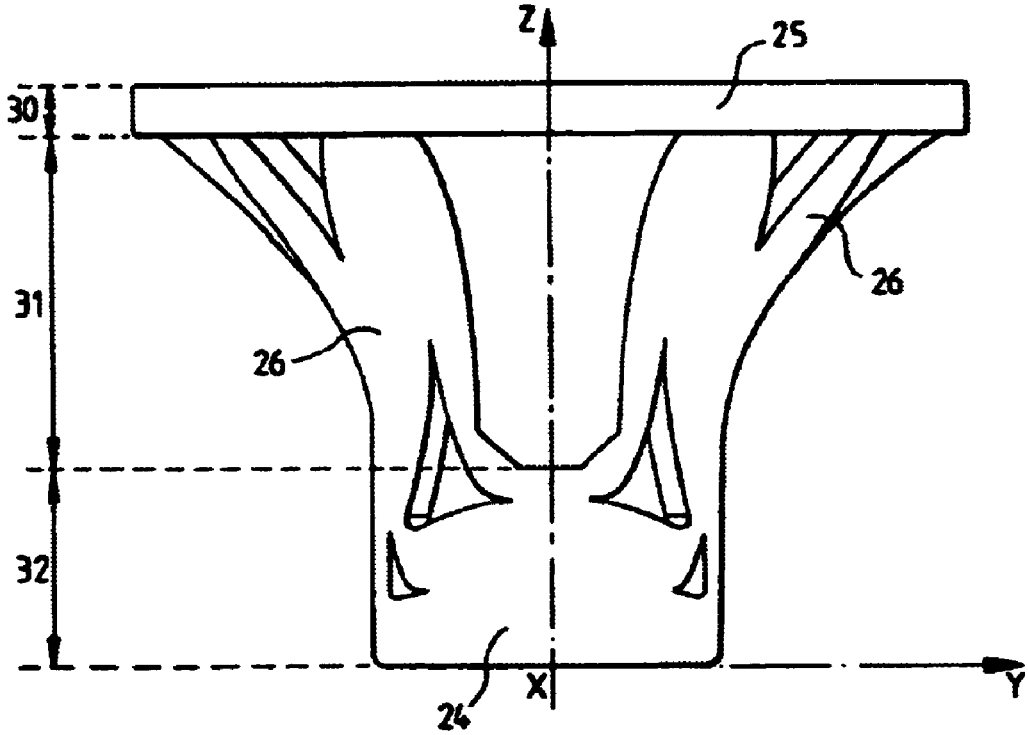

FIGS. 2A and 2B illustrate the state of the art in which the vertical deflection coils 4 are saddle-shaped. Each coil comprises loops of conductors forming a rear conductor assembly 24 lying in the rear zone 32, a front conductor assembly 25 lying in the front zone 30, the two conductor assemblies being connected by lateral conductor bundles 26 in an intermediate zone 31. The plane P of symmetry of each vertical deflection coil is, in the case illustrated in FIGS. 2A and 2B, the XZ plane.

Figure 3A:
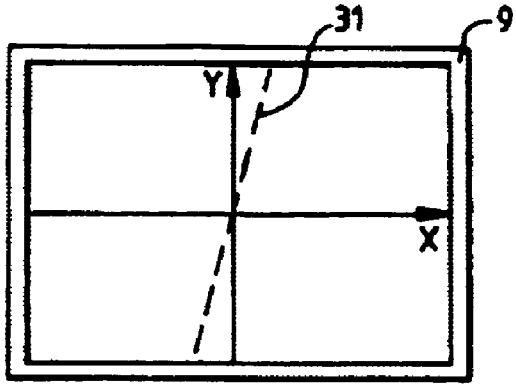
FIGS. 3A, 3B, 3C illustrate orthogonality and parallelogram defects for which the invention provides a solution.
Figure 3B:
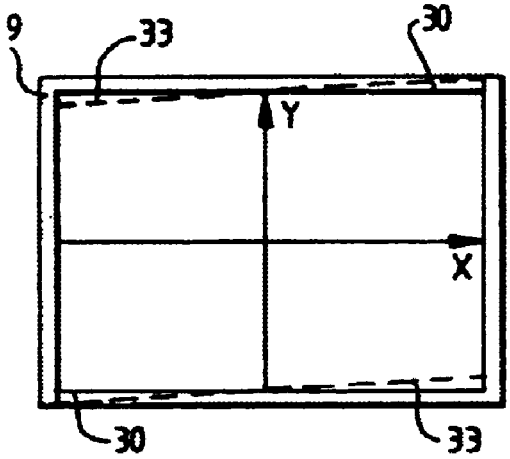
Figure 3C:
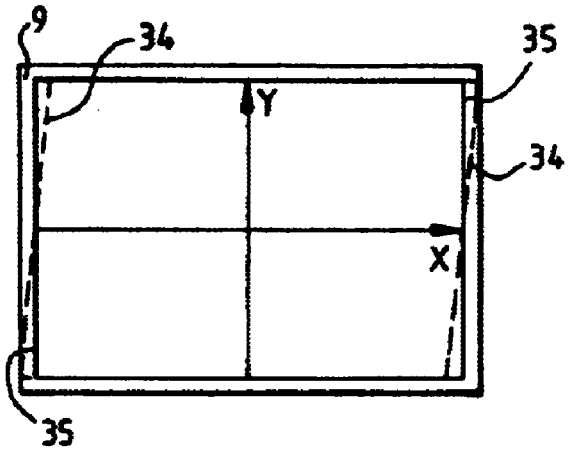

During manufacture of a deflection yoke, parameters defined in the design stage may be affected by the industrial manufacturing process or by the equipment used for manufacturing said deflection yoke. For example, the cross-modulation causes orthogonality and parallelogram defects. These defects are manifested on the screen of the tube in the following manner:

- in the case of the orthogonality defect, as shown in FIG. 3A, by the fact that the line 31 generated by the green central beam on the screen 9 of the tube for producing the vertical axis Y is not coincident with said axis;
- in the case of the parallelogram defect, as illustrated in FIGS. 3B, 3C, by the fact that the lines 33, 34 generated by the green beam for producing the horizontal edges 30 and vertical edges 35 of the image are not coincident with said edges.

The solution to these problems consisted hitherto in taking into account these defects in a new design step and thus arriving, by successive approximations, in obtaining a deflection yoke whose characteristics comply with specifications.

Figure 4:
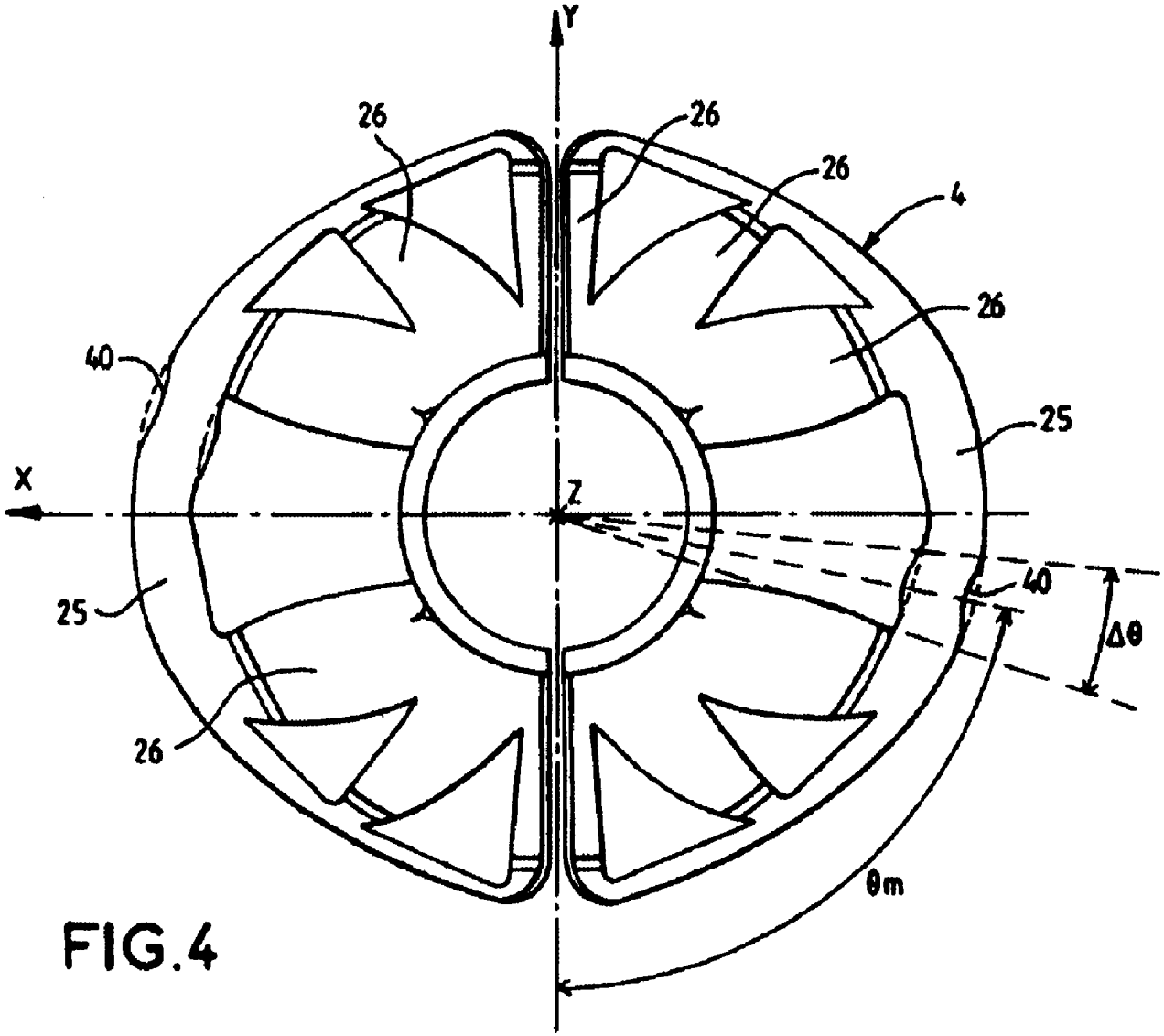
FIG. 4 illustrates one embodiment of the invention.
Figure 5:
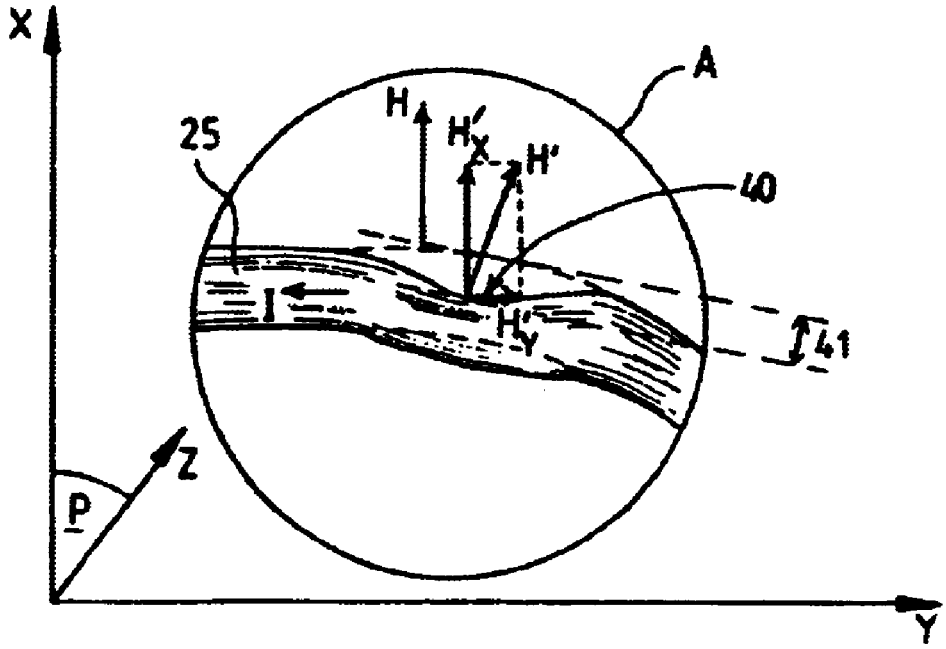
FIG. 5 shows the influence of the shape of the coil according to the invention on the field at the front of said coil.

The invention aims to provide a simple solution to these problems without modifying the design of the deflection yoke and therefore without modifying the beam-convergence or coma parameters. To do this, the rear conductor assembly 24 and the lateral conductor bundles 26 are not modified and are placed symmetrically with respect to a plane P, this plane being coincident with the plane defined by the main axis Z of the tube and the horizontal axis X in the case of the vertical deflection coils; the front conductor assembly is modified so as to introduce a dissymmetry into the conductor assembly with respect to the plane P, in a zone A of said conductor assembly, this dissymmetry being in the form of a depression or a notch, as illustrated in FIG. 4. FIG. 5 shows a depth depression 41 created on the outside of the conductor assembly and the effect of this dissymmetry on the field H created by the current flow in the conductors of said front conductor assembly 25. The field H undergoes a slight rotation with respect to the direction which it would have in the absence of the dissymmetry, and the resulting field H' introduces, in particular, a component H' Y' This rotation, acting at the front of the deflection yoke, only influences the geometry of the image generated on the screen of the tube; the component H'y compensates for the shift between the direction of the horizontal deflection field and the perpendicular to the vertical deflection field in order to cancel out the effects of said shift.

Figure 7:
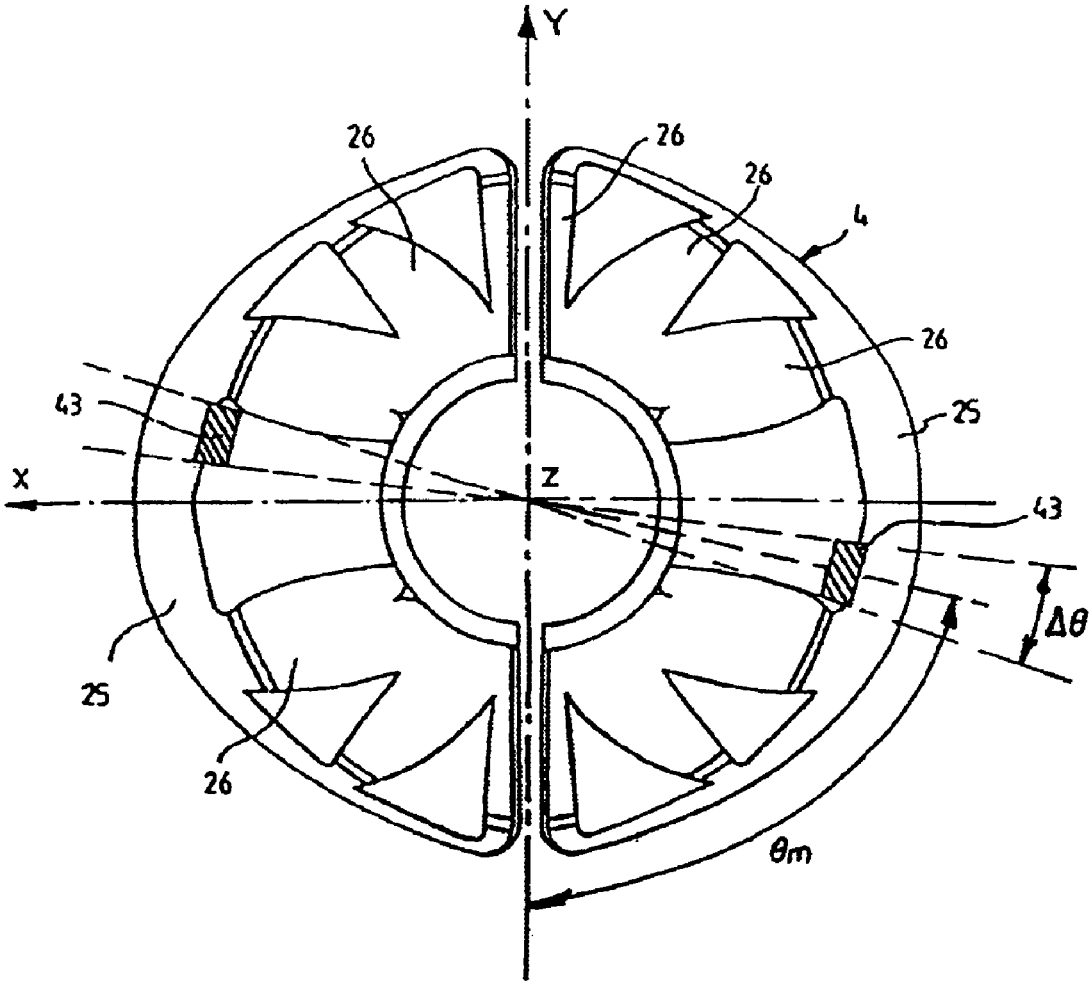
FIG. 7 illustrates another embodiment of the invention and the influence on the deflection field at the front of the coil.

In another embodiment of the invention, illustrated in FIG. 7, a metal plate 43 is placed close to the front conductor assembly 25 of the vertical deflection coil. At this part of the coil, the piece 43, which forms a magnetic screen, may either increase or decrease the intensity of the magnetic field acting as the election-beam deflection field, depending on whether the said metal piece 43 is placed above or below the front conductor assembly. FIG. 7 shows a metal piece 43 lying below the front conductor assembly 25 of the vertical deflection coil.

The metal piece 43 introduces a local modification of the amplitude of the frame field and consequently a proportional modification of the amplitude of the component of the field along the Y axis. This local modification of the component of the field along the Y axis compensates for the shift between the direction of the horizontal deflection field and the perpendicular to the vertical deflection in order to cancel out the effects of the said shift.

Since the influence of the horizontal deflection coils is preponderant in the cross-modulation problems, it would appear to be preferable to introduce the compensation effect described above into the vertical deflection coils, without thereby excluding the possibility of modifying, in the same way, the front conductor assembly of the saddle-shaped horizontal deflection coils in order to obtain the same effect of a local modification of the direction of the field generated by said coils.

As illustrated in FIG. 4, which shows, seen from the rear, a pair of vertical deflection coils according to the invention, the depression 40, located on the front conductor assembly 25 of the vertical deflection coils 4, extends in a radial plane with an angular aperture $\Delta\theta$ about a mean angle $\theta m$ measured with respect to the direction of the plane of separation YZ of the two vertical deflection coils; the same applies to the position of the metal piece 43 locally modifying the deflection field. From experience, it has been shown that the optimum effect was obtained by choosing a mean angle of between 60° and 90° for the vertical deflection coils and between 45° and 90° for the horizontal deflection coils.

Depending on the cross-modulation amplitude to be corrected, the depth 41 of the depression created on the conductor assembly will vary, as will the angular aperture $\Delta\theta$ over which said depression extends. In addition, it may be advantageous to place several depressions or notches on the same conductor assembly in order to modulate their effects. Likewise, it is possible to have one or more plates in order to locally modify the field at one or more points close to the front conductor assembly of the coil.

Owing to the fact that the currents in the front conductor assemblies 25 are in opposite directions and that, in the right half-screen and in the left half-screen, the forces exerted on the electron beams must be in opposite directions in order to correct the effects of the cross-modulation on the geometry of the image, the depression (s) or notch (es) of the front conductor assembly of one of the coils and the depression (s) or notch (es) of the front conductor assembly of the other coil of the same pair of deflection coils are generally arranged symmetrically with respect to the Z axis, if there is no additional correction to be introduced between the two coils of the same pair. The same applies in the case of the metal plates (43) for modifying the magnetic field which themselves will also be arranged symmetrically with respect to the Z axis.

Figure 6:
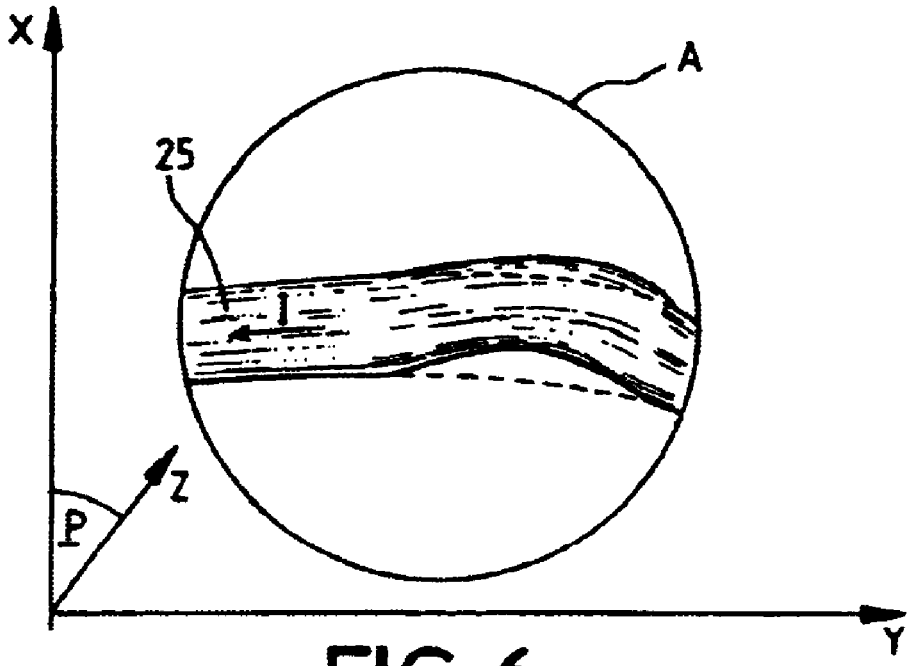
FIG. 6 illustrates a second embodiment of the invention.

The depressions or notches may be arranged on the outer part of the conductor assembly, as indicated in FIG. 5, or on the inner part of the conductor assembly, as indicated in FIG. 6, depending on the local orientation which it is desired to give to the deflection field.

A major advantage of the invention is that it is easy to implement. If it is the shape of the coil which is modified, the coil shaper is simply modified by inserting a wedge in the front, the shape of which wedge is matched to the shape of the depression to be produced on the conductor assembly of the coil; it is therefore no longer necessary to redefine a new mould, something which previously represented a significant additional cost. When the amplitude of the field is locally modified by means of metal plates, it is possible to place those plates, for example, by adhesively bonding them to the plastic body of the deflection yoke separator; this solution is particularly simple to implement as it avoids any modification of the coils themselves.

What is claimed is:

1. A deflection yokes for a cathode-ray tube, comprising:

a pair of horizontal deflection coils and a pair of vertical deflection coils for generating magnetic deflection fields perpendicular to a main axis of said cathode-ray tube, one of said pairs consisting of saddle-shaped coils having conductive wires arranged so as to form a front conductor assembly and a rear conductor assembly coupled to each other by lateral conductor bundles, and those parts of each of said coils which form the rear conductor assembly and the lateral bundles being arranged approximately symmetrically with respect to a plane;

a first metal plate placed near the front conductor assembly for locally modifying one of the direction and the amplitude of the magnetic field created by the current flow in said front conductor assembly so that, considering a first zone of the front conductor assembly and a second zone symmetrical with the first zone with respect to the plane, the fields created in the first and second zones are not symmetrical with respect to said plane; and a second metal plate wherein said first and second metal plates extend on both of the saddle-shaped coils of the same pair, symmetrically with respect to the Z axis, the first and second metal plates locally modifying the amplitude of the magnetic field with the same strength.

2. A deflection yoke according to claim 1, wherein the two saddle-shaped coils are the vertical deflection coils.

3. A deflection yoke according to claim 1, wherein said first metal plate extends, in a plane perpendicular to the Z axis, about a mean radial direction of between 60° and 90° measured with respect to the direction of the plane of separation of the two coils of the same pair.

* * * * *